US006532912B2

(12) United States Patent
Möller et al.

(10) Patent No.: US 6,532,912 B2
(45) Date of Patent: Mar. 18, 2003

(54) PISTON COOLING SYSTEM FOR AN INTERNAL COMBUSTION ENGINE

(75) Inventors: Heribert Möller, Sachsen (DE); Josef Winter, Rednitzhembach (DE)

(73) Assignee: MAN Nutzfahrzeuge AG (DE)

( * ) Notice: Subject to any disclaimer, the term of this patent is extended or adjusted under 35 U.S.C. 154(b) by 0 days.

(21) Appl. No.: 09/861,162

(22) Filed: May 17, 2001

(65) Prior Publication Data

US 2001/0042526 A1 Nov. 22, 2001

(30) Foreign Application Priority Data

May 17, 2000 (DE) ..... 100 24 207

(51) Int. Cl.[7] ..... F01P 1/04
(52) U.S. Cl. ..... 123/41.35
(58) Field of Search ..... 123/41.35

(56) References Cited

U.S. PATENT DOCUMENTS 4,010,718 A * 3/1977 Stewart ..... 123/41.35
5,881,684 A * 3/1999 Bontaz ..... 123/41.35

* cited by examiner

*Primary Examiner*—Noah P. Kamen
(74) *Attorney, Agent, or Firm*—R W Becker & Associates; R W Becker

(57) ABSTRACT

A piston cooling system is provided for an internal combustion engine having a crankshaft, a plurality of pistons connected to the crankcase shaft, and a crankcase housing partitioned by a plurality of partition walls into a plurality of partitioned sections, and a pressurized lubrication fluid circuit integrated with the crankcase housing for the circulation of lubricant therethrough. The piston cooling system includes a plurality of bores each formed in a respective partition wall and communicated with the pressurized lubricant fluid circuit. The piston cooling system also includes a plurality of spray nozzles, each spray nozzle being mounted in a longitudinal bore formed in a respective partition wall. Each spray nozzle is oriented for spraying lubricant onto the underside of a piston. Each spray nozzle is formed by a lathe process.

5 Claims, 3 Drawing Sheets

PISTON COOLING SYSTEM FOR AN INTERNAL COMBUSTION ENGINE

BACKGROUND OF THE INVENTION

The present invention relates to a piston cooling system for an internal combustion engine.

It is known to deploy spray nozzles for spraying a coolant against the undersides of the pistons of an internal combustion engine. Lubricating oil drawn from a pressurized oil circuit is used as the coolant. In one conventional arrangement, the spray nozzle is formed as a bent pipe mounted to a console or bracket which, in turn, is bolt mounted to an inner surface of the crankcase housing such that coolant is propelled through the bent pipe against the underside of a piston.

A disadvantage of the just described conventional arrangement is that the bent pipe is mounted to the console by a solder weld. The console itself is secured by a bolt to the inner surface of the crankcase housing. Due to the difficulty of accessing the area where the spray nozzle is installed onto the crankcase housing, this installation work can only be accomplished by hand and is for that reason very costly while, moreover, the solder welding of the console and the bent pipe of the spray nozzle add to the cost.

SUMMARY OF THE PRESENT INVENTION

The present invention provides a piston cooling system which permits the spray nozzles to be fabricated as compact pieces formed by a lathe process such that the time consuming work activities such as the bending of pipe, solder welding, and other activities can be dispensed with. Additionally, the spray nozzles of the piston cooling system of the present invention can be easily installed into their operating orientations within the longitudinal bores which receive them by means of a work tool such as, for example, a robot.

Due to the ability to install the spray nozzles into their operating orientations, the orientations of the spray patterns of these spray nozzles are clearly defined and damage to the internal combustion engine due to deficient cooling of its pistons can be prevented. In contrast, the spraying precision of a conventional spray nozzle formed by a bent pipe cannot be guaranteed. The manual installation requirements of such conventional spray nozzles are not consistent with the mass production of items such as vehicle internal combustion engines.

The spray nozzles of the present invention, which are pieces formed by a lathe process, can be fabricated in a pure, fully automatic manner by machining, which is a cost favorable process, and can accordingly have uniform quality.

BRIEF DESCRIPTION OF THE DRAWINGS

This object, and other objects and advantages of the present invention, will appear more clearly from the following specification in conjunction with the accompanying schematic drawings, in which.

DESCRIPTION OF THE PREFERRED EMBODIMENT

Figure 1:
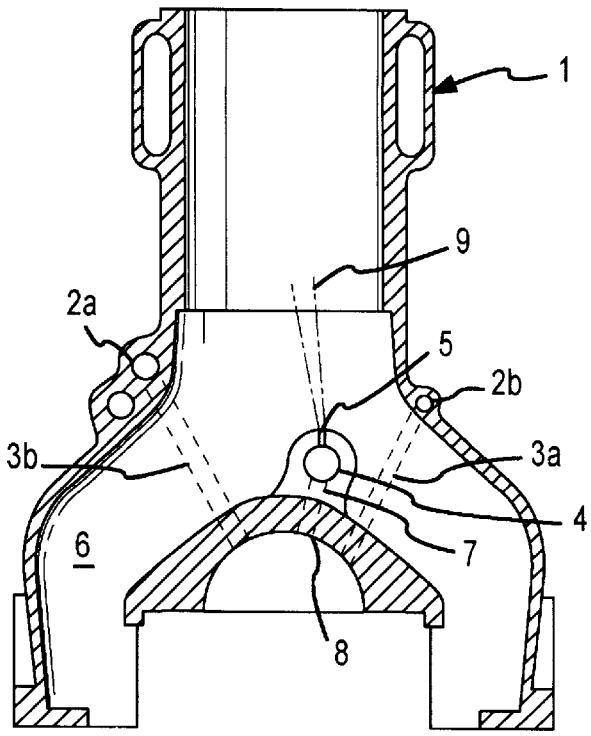
FIG. 1 is a sectional side view, taken along lines I—I of FIG. 3, of a crankcase housing of an internal combustion engine with the crankcase housing having longitudinal bores and branch bores for the supply of lubricant fluid to be sprayed against the pistons of the internal combustion engine.

FIG. 1 is a sectional view of a crankcase housing 1 having lubrication oil supply bores 2*a,* 2*b* which are integrated into a pressurized oil lubrication circuit and which extend longitudinally in the crankcase housing 1. Lubrication oil is supplied via bores 3*a,* 3*b* to the crankshaft bearings. The lubrication oil is also drawn into the system for piston cooling purposes. In accordance with the present invention, the piston cooling is effected by spraying of the lubrication oil through spray nozzles 4 which are arranged in the longitudinal bores 5 of the partition walls 6 between which the crankcase partitioned spaces are located. The supply of oil to the spray nozzles 4 follows a course from the lubrication oil supply bores 2*b* via the bore 3*a,* which supplies the bearing lubrication, and thereafter through a bore 7. The bores 3*a* and 7 are communicated with one another via a chamber 8. The spray nozzles 4 create an oil spray 9 directed against an underside of a piston. The assembly of the spray nozzles 4 in accordance with the present invention permits precise orientation of the direction of the oil spray 9.

Figure 2:
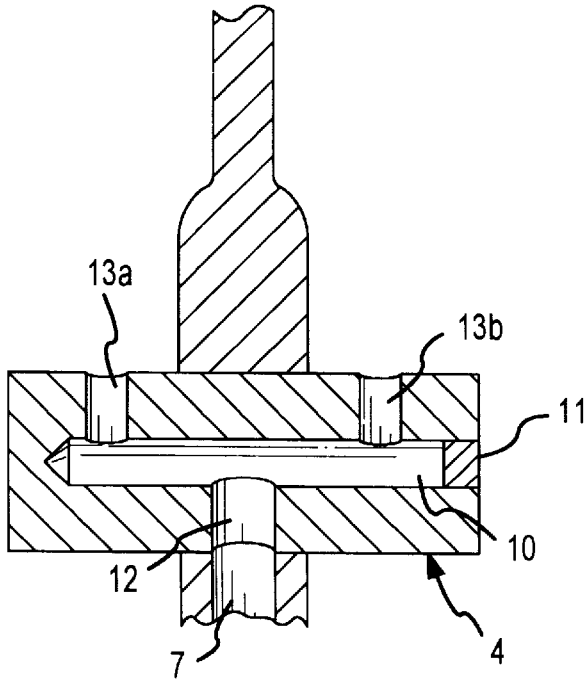
FIG. 2 is a sectional view of a spray nozzle formed by a lathe process.

FIG. 2 shows details of a spray nozzle 4. The spray nozzle 4 is fabricated as a piece formed solely by a lathe or other machining process. The spray nozzle 4 includes a central cross bore 10 which is blocked at one end by a stopper 11. Cooling oil is supplied into the spray nozzle 4 via a supply bore 12 thereof. The supply bore 12 is aligned for fluid communication with the bore 7 in the respective partition wall 6 upon assembly of the spray nozzle 4 into the respective longitudinal bore 5 (see FIG. 1). The jetting of the oil from the spray nozzle 4 is effected by jetting bores 13*a,* 13*b*. The advantage of the spray nozzles 4 of the present invention can be seen in the fact that they can be fabricated solely by machining—thus, by automatic lathes. In the fabrication of mass produced articles such as the spray nozzles for assembly into vehicle motors, cost factors are without a doubt a critical consideration.

Figure 3:
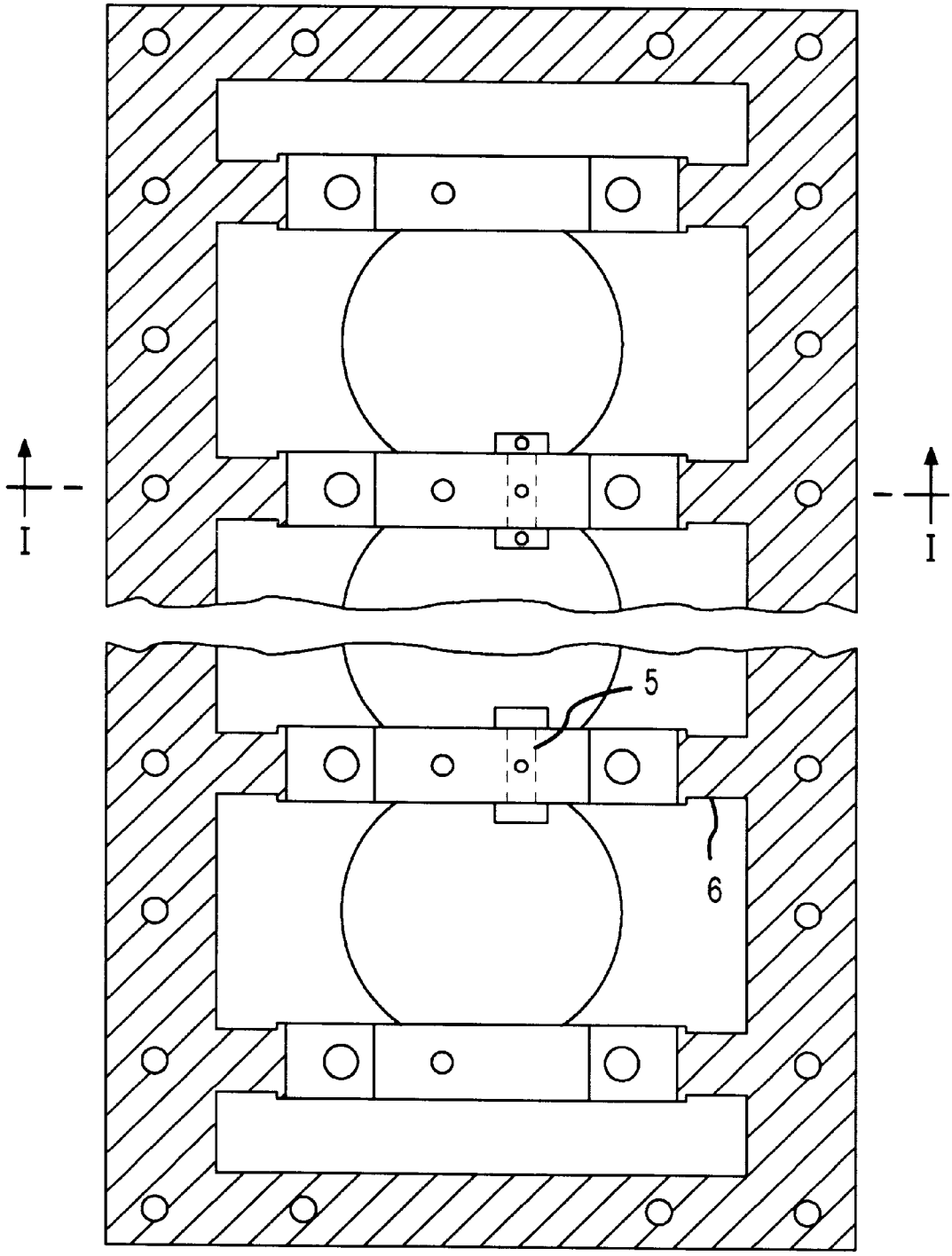
FIG. 3 is a sectional bottom plan view of the crankcase housing showing the spray nozzles assembled therein.

FIG. 3 is a bottom sectional view of the crankcase housing 1 as seen from the direction of the oil pan or reservoir. Each of the partition walls 6 includes a longitudinal bore 5. These longitudinal bores 5 extend through the series of partition walls 6 coaxially with one another and parallel to the center line of a crankshaft.

The spray nozzles 4 are assembled into the longitudinal bores 5 such that the oil sprays 9 which are jetted out of the jetting bores 13*a,* 13*b* are aimed at the desired locations.

Figure 4:
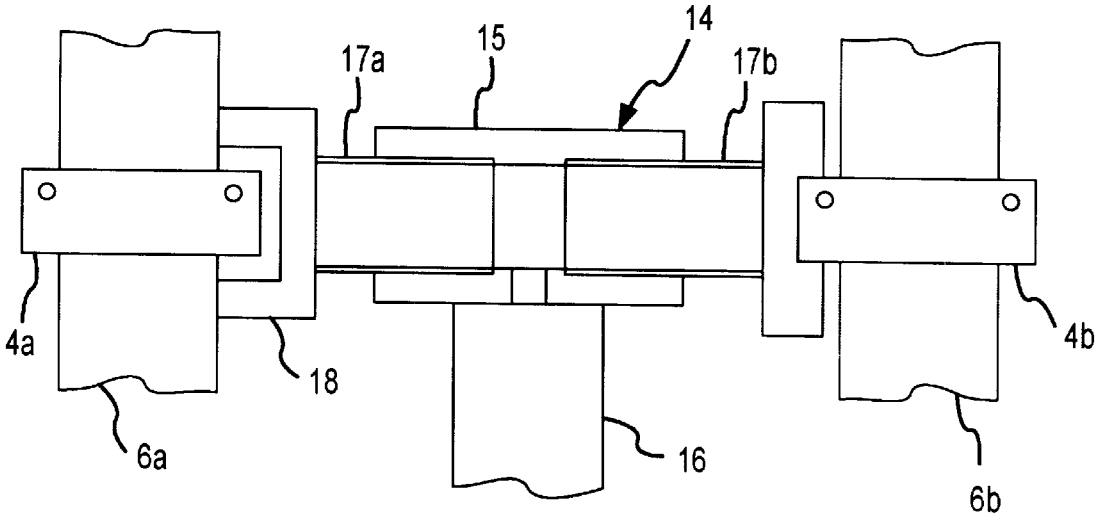
FIG. 4 is a work tool for assembling the spray nozzles into the longitudinal bores of the crankcase housing.

FIG. 4 shows details of the assembly of the spray nozzles 4 into the crankcase housing by means of a work tool. The work tool is principally comprised of a hydraulic piston cylinder unit 14. The cylinder 15 is fixedly connected with a positioning arm 16 which may be part of, for example, a robotic assembly device. Two pistons 17*a,* 17*b* are disposed in the cylinder 15 for free axial movement relative thereto. The piston 17*a* includes an end piece 18 which extends over and at a spacing from a spray nozzle 4*a,* which has previously been installed into a respective partition wall 6*a,* and is in contact with the partition wall 6*a* to thereby support the piston 17*a* against the partition wall. Once the end piece 18 is in its support contact position against the partition wall 6*a*, a pressurization develops within the cylinder 15 which effects movement of the second piston 17*b* in a cylinder outward direction such that the piston presses the spray nozzle 4*b* into the bore in a second partition wall 6*b* in a manner such that the spray nozzle 4*b* is reliably prevented from making a turning movement or being displaced. Due to the free movement of the pistons 17*a*, 17*b* in the cylinder 15, the positioning arm 16 can be held in a torque or rotational moment-free manner, despite the very strong forces which are exerted to effect the pressing in of the spray nozzles 4*a*, 4*b* into their respective bores. The assembly of the spray nozzles can thus be carried out via robots in a fully automatic manner.

Figure 5:
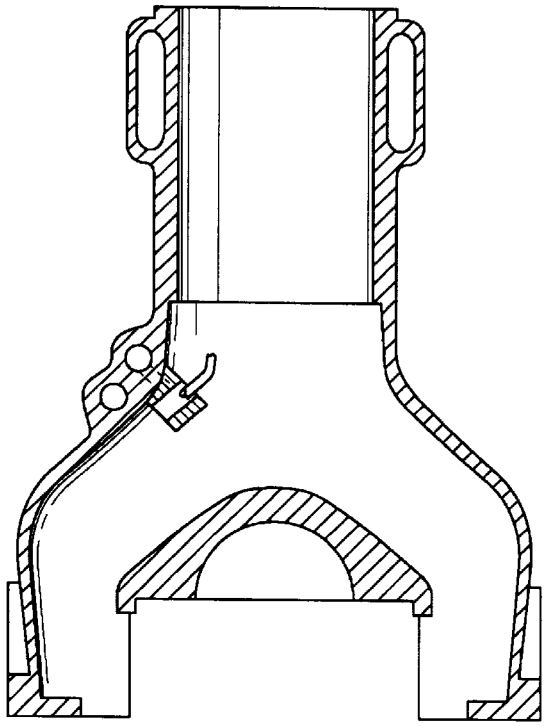
FIG.5 PRIOR ART
FIG. 5 is a sectional side view of a crankcase housing of an internal combustion engine having conventional spray nozzles comprising pipes.

FIG. 5 shows a conventional spray nozzle. The spray nozzle is comprised of a bent pipe which is secured to a console by a soldered joint. The console itself is bolted onto a machined surface so that the spray from the spray nozzle is directed against the underside of a piston. The disadvantage of this conventional arrangement is that the pipe is secured to the console via a soldered joint. This soldered joint cannot, without additional handling, be fabricated in an automatic manner. The bolted disposition of the console forecloses, in any event, the possibility of automatic mounting of the arrangement for the reason that an exact position of the console is very difficult to achieve.

The specification incorporates by reference the disclosure of German priority document 100 24 207.3 of May 17, 2000.

The present invention is, of course, in no way restricted to the specific disclosure of the specification and drawings, but also encompasses any modifications within the scope of the appended claims.

What we claim is:

1. A piston cooling system for an internal combustion engine having a crankshaft, a plurality of pistons connected to the crankcase shaft, and a crankcase housing partitioned by a plurality of partition walls into a plurality of partitioned sections, and a pressurized lubrication fluid circuit integrated with the crankcase housing for the circulation of lubricant therethrough and including a plurality of longitudinal bores each extending through a respective one of the partition walls of the crankcase housing generally coaxially with one another and generally parallel to the crankshaft, the piston cooling system comprising:

a plurality of bores each formed in a respective partition wall and communicated with the pressurized lubricant fluid circuit; and a plurality of spray nozzles, each spray nozzle being mounted in a respective longitudinal bore and oriented for spraying lubricant onto the underside of a piston and being communicated with a respective bore such that each spray nozzle is fluidly communicated with the pressurized lubricant fluid circuit wherein each spray nozzle is formed by a lathe process and has a cross bore having a pair of opposed open ends, a pair of stop pieces each disposed in a respective open end of the cross bore, an inlet bore communicated with the cross bore, and a pair of spray holes disposed generally symmetrically from the axial midpoint of the cross bore, whereby the lubricant fluid flows through the inlet bore, thereafter into the closed off cross bore, and is sprayed out of the spray holes and the inlet bore is aligned for fluid communication with the bore of the respective partition wall in which the spray nozzle is mounted.

2. A piston cooling system according to claim 1, wherein the spray nozzles are retained by friction fit in the longitudinal bores.

3. A piston cooling system according to claim 1, wherein each spray nozzle is assembled into its mounted disposition in the respective longitudinal bore by a work tool configured as a hydraulic piston and cylinder unit having a cylinder and a positioning arm fixedly secured to one another, the work tool for inserting a spray nozzle into the longitudinal bore of the respective associated partition wall and the cylinder freely movably retaining a pair of pistons each movable by hydraulic force axially outwardly of the cylinder in an opposite axial direction to the other piston and one piston having an axial outer head configured to extend over an already installed spray nozzle and to support the work tool on the respective partition wall having the already installed spray nozzle therein while the other piston inserts another spray nozzle into the longitudinal bore of another partition wall in response to hydraulic pressure against the pistons.

4. A piston cooling system according to claim 1, wherein each spray nozzle is assembled by a work tool into its mounted disposition in the respective associated longitudinal bore.

5. A piston cooling system according to claim 1, wherein each spray nozzle is formed by a lathe process and is assembled by a work tool into its mounted disposition in the respective associated longitudinal bore.

* * * * *